US007195051B2

(12) United States Patent
Nien

(10) Patent No.: US 7,195,051 B2
(45) Date of Patent: Mar. 27, 2007

(54) COLLAPSING AND SECURING DEVICE OF LATERAL BLINDS

(75) Inventor: Ming Nien, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/969,022

(22) Filed: Oct. 21, 2004

(65) Prior Publication Data

US 2006/0086469 A1 Apr. 27, 2006

(51) Int. Cl.
*E06B 9/15* (2006.01)

(52) U.S. Cl. ..... 160/243; 160/84.04

(58) Field of Classification Search ..... 160/243, 160/84.01, 84.04, 368.1, 166.1, 241
See application file for complete search history.

(56) References Cited

U.S. PATENT DOCUMENTS 1,752,610 A * 4/1930 McSpadden ..... 160/84.04
1,847,077 A * 3/1932 Boeck ..... 160/133
3,777,800 A * 12/1973 Susoev ..... 160/84.04
4,079,772 A * 3/1978 Klaenhammer et al. . 160/268.1
4,419,982 A * 12/1983 Eckels ..... 126/625
4,436,137 A * 3/1984 Charles ..... 160/242
4,836,265 A * 6/1989 Bussert ..... 160/354
4,880,045 A * 11/1989 Stahler ..... 160/84.04
5,010,944 A * 4/1991 Bussert ..... 160/354
5,025,848 A * 6/1991 Prochaska ..... 160/368.1
5,074,348 A * 12/1991 Phillips ..... 160/38
5,158,127 A * 10/1992 Schumacher ..... 160/84.07
5,524,693 A * 6/1996 Hamilton ..... 160/243
5,785,105 A * 7/1998 Crider et al. ..... 160/243
6,443,207 B1 * 9/2002 Cheng et al. ..... 160/84.04
6,860,312 B2 * 3/2005 Judkins ..... 160/243
6,942,001 B1 * 9/2005 Crider et al. ..... 160/241

* cited by examiner

*Primary Examiner*—David Purol
(74) *Attorney, Agent, or Firm*—Troxell Law Office PLLC

(57) ABSTRACT

A collapsing and securing device of a lateral blind includes a lateral blind such as a winding blind, a Roman blind, or a cloth blind, and a number of positioning members fixed at least on one surface of the window curtain, and the positioning members can temporarily adhere, stick or attract each other to secure the lateral blind at one of many collapsed position in case the lateral blind is manually wound up, without using pull ropes with a pool as used in a conventional lateral blind for preventing potential dangers involved in conventional lateral blinds. The collapsed lateral blind can be expanded down manually with easiness and quickness, with the temporarily adhered, stuck or attracted together positioning members separated from one another with easiness.

15 Claims, 9 Drawing Sheets

COLLAPSING AND SECURING DEVICE OF LATERAL BLINDS

BACKGROUND OF THE INVENTION

1. Field of the Invention

This invention relates to a collapsing and securing device of lateral blinds, particularly to one manually handled without using a pull rope as used in a convention lateral blind for effectively preventing potential dangers from happening.

2. Description of the Prior Art

Conventional lateral blinds such as winding blinds, roman blinds, or cloth blinds generally are provided with a pull rope with a loop for a user to pull for collapsing and expanding them and secured at one of many wound-up (or collapsed) positions, for opening or closing them so as to attain shading sunlight or to make the blinds as a decoration, or keeping its interior of a room from being seen from the exterior.

However, the pulling rope is always provided with a loop for griping and exposed and drooping down so there is a potential danger of the neck of a small child getting caught by the loop of the pull rope of the child is playing near the blind. Therefore, it is a pressing need that this unseen danger has to be gotten rid of conventional lateral blinds.

SUMMARY OF THE INVENTION

A collapsing and securing device of lateral blinds in the invention has a number of positioning members fixed at least on one surface of a lateral blind so that the positioning members can temporarily adhere, stick or attract one another to secure the lateral blind at one of many collapsed (or wound up) position in case the lateral blind is manually wound up. The collapsed lateral blind can also easily be released to expand down manually. The invention does not use pull ropes with a pool as used in a conventional lateral blind, preventing potential dangers that a small child's neck may be hooked by the pool of the pull ropes, as may happen to the conventional lateral blinds.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
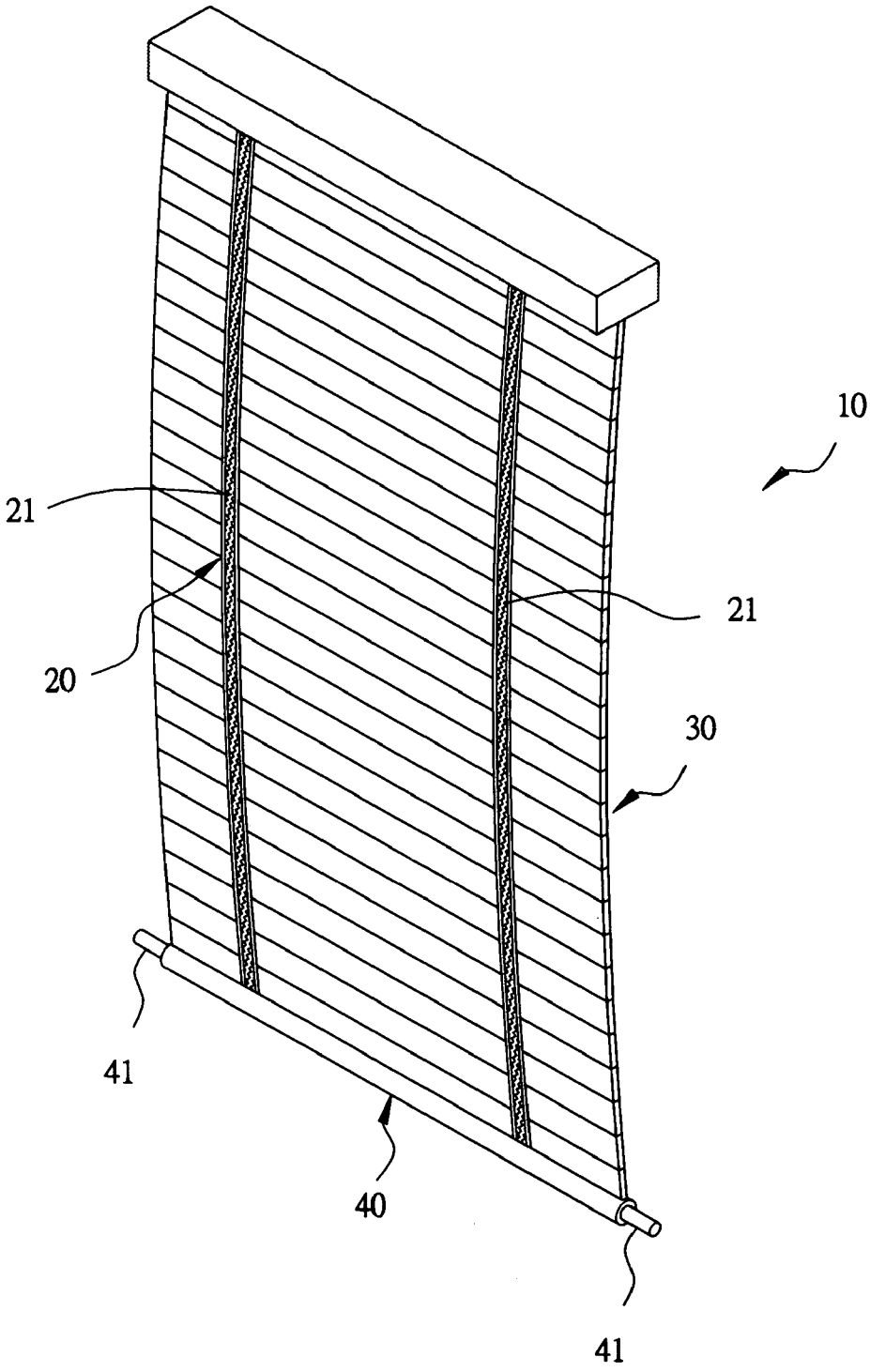
FIG. 1 is a perspective view of a lateral blind provided with a first embodiment of a collapsing and securing device in the present invention.
Figure 2:
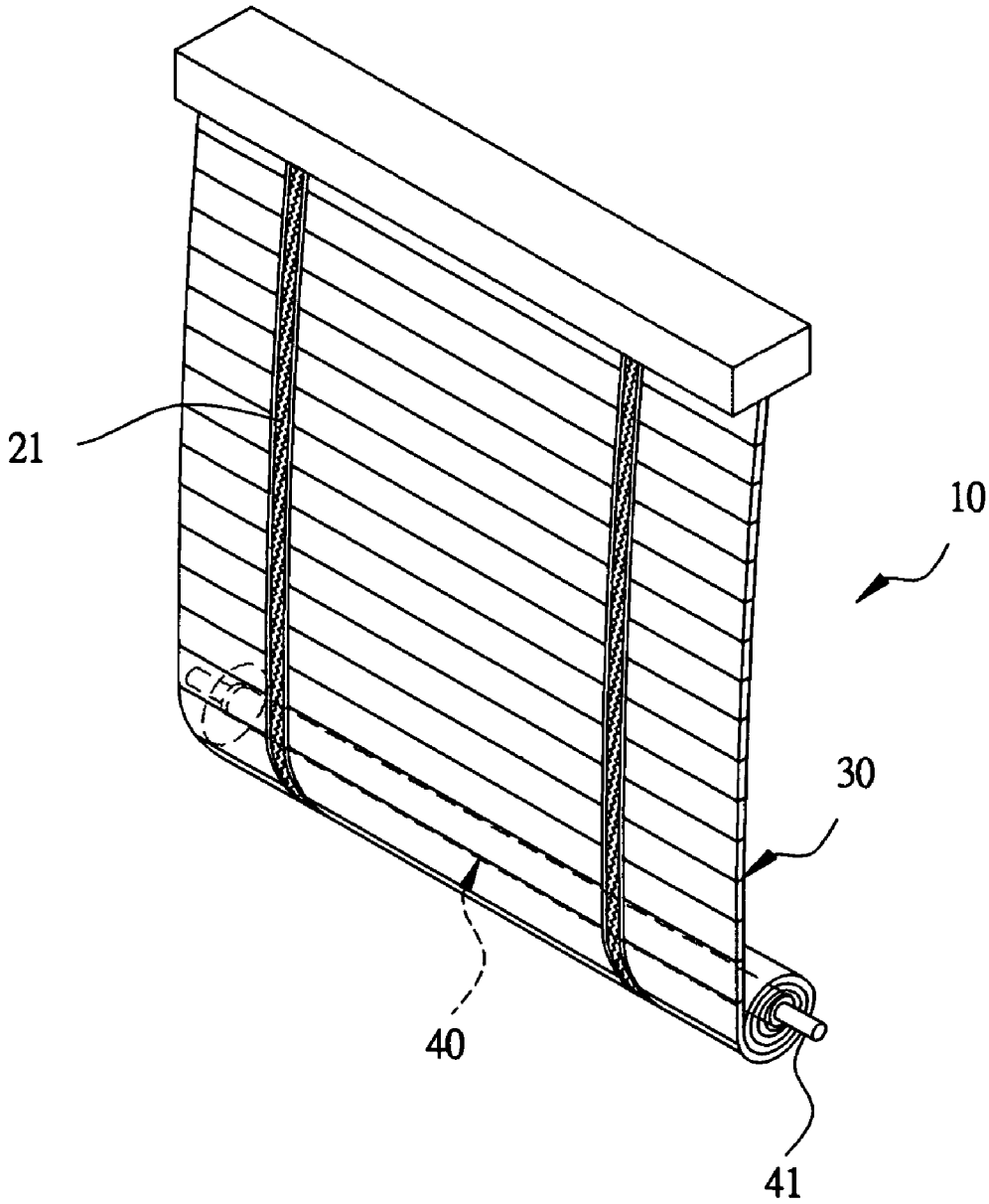
FIG. 2 is a perspective view of the lateral blind provided with the first embodiment of a collapsing and securing device in the present invention, showing it being collapsed.
Figure 3:
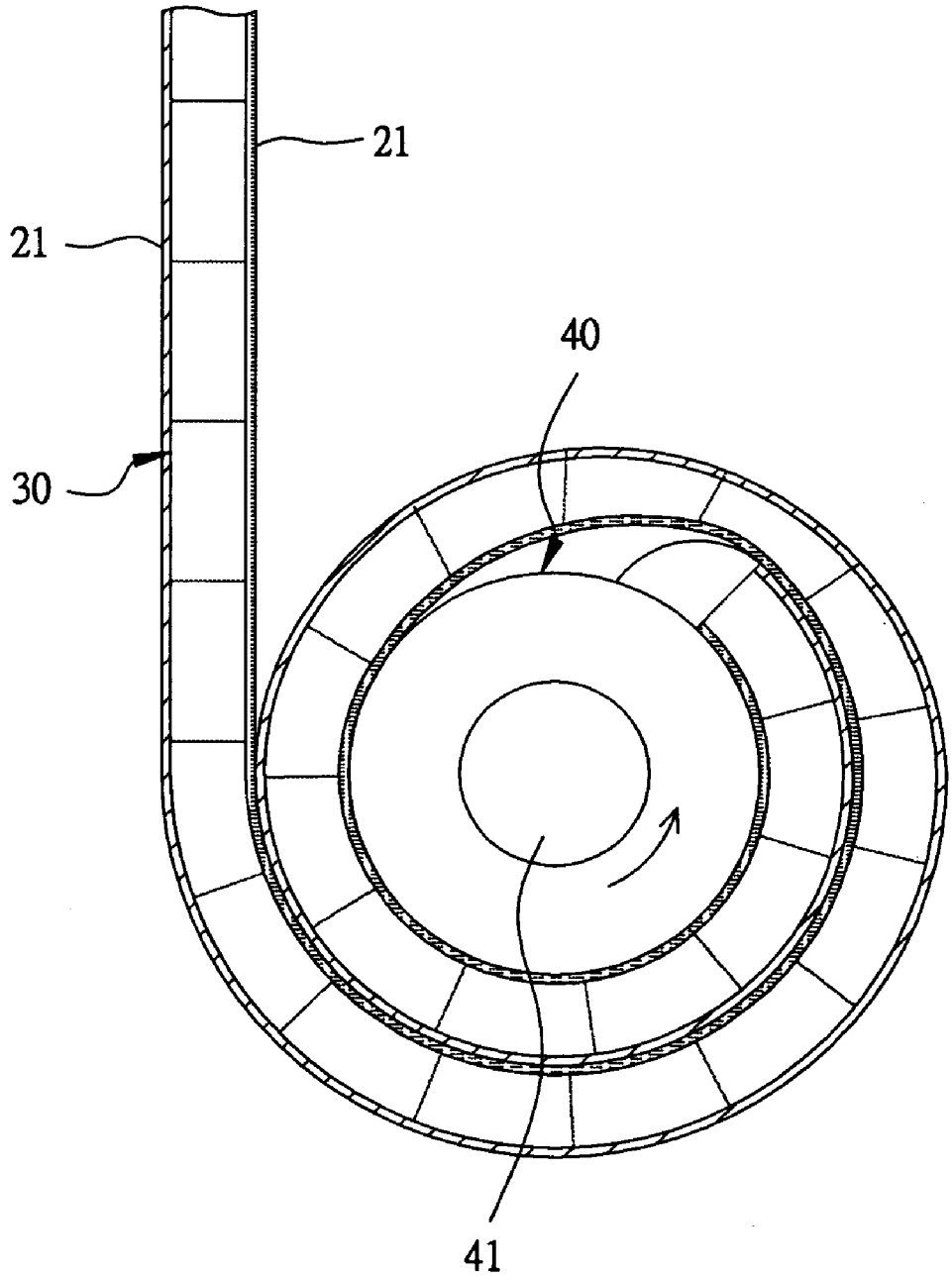
FIG. 3 is a partial side cross-sectional view of the lateral blind provided with the first embodiment of a collapsing and securing device in the present invention, showing it being collapsed.

A first embodiment of a collapsing and securing device of a lateral blind in the present invention, as shown in FIGS. 1, 2 and 3, includes a lateral blind 10, two positioning members 20, blind strips 30, and a lower rod 40, as main components.

The lateral blind 10 is composed of plural curtain strips 30 forming a front body and a rear body of the lateral blind 10.

The two positioning members 20 are made of Velcro bands 21, adhered lengthwise and parallel on a left side and a right side of the outer surface and of the inner surface of the lateral blind 10 from an upper edge to the lower edge.

The lower rod 40 is combined with the lower end of the lateral blind 10 and protruding out of the right and the left side edge of the lateral blind 10 for a proper length to form respectively a grip 41 for a user to hold.

In using the first embodiment of the collapsing and securing device, a user holds the two grips 41 of the lower rod 40 and winds up the lower rod 40 toward the rear side of the lateral blind 10, letting the Velcro bands 21 of the outer positioning members 20 on the outer surface of the lateral blind 10 coming to contact and adhere to the Velcro bands 21 of the inner positioning members on the inner surface of the lateral blind 10 so that the wounded portion of the winding curtain 10 may be kept immovable at that position, with the lower rod 40 not rolling down. Thus, the lateral blind 10 can be collapsed to any of many wounded-up positions as needed.

On the contrary, if the wounded-up (or collapsed) lateral blind 10 is wanted to be pulled Or expanded down, a user holds the two grips 41, pulls and rolls the lower rod 40 down, with the two sets of the Velcro bands 21 of the position members 20 mutually and forcefully separated from each other.

Figure 4:
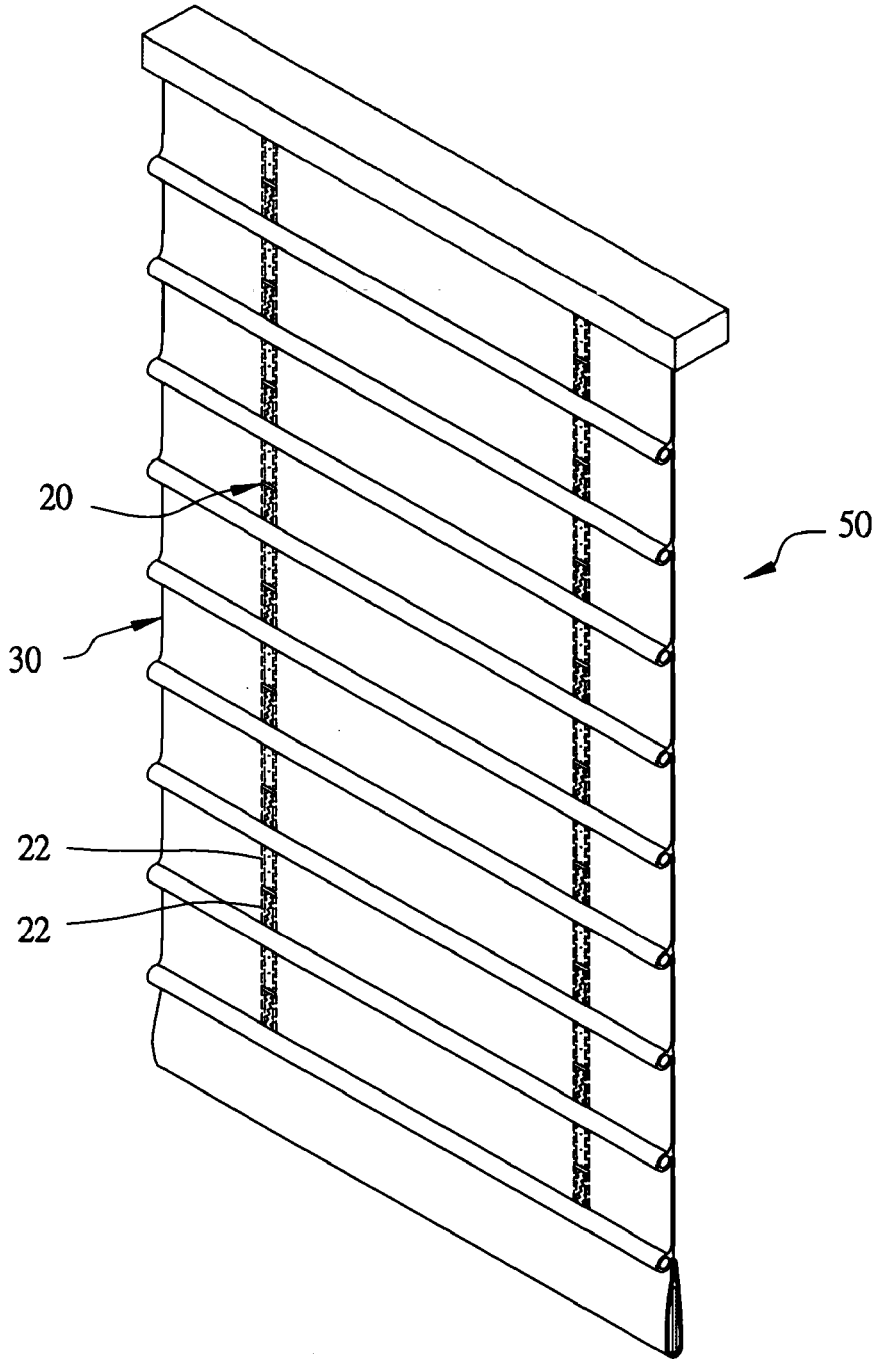
FIG. 4 is a perspective view of a lateral blind provided with a second embodiment of a collapsing and securing device in the present invention.
Figure 5:
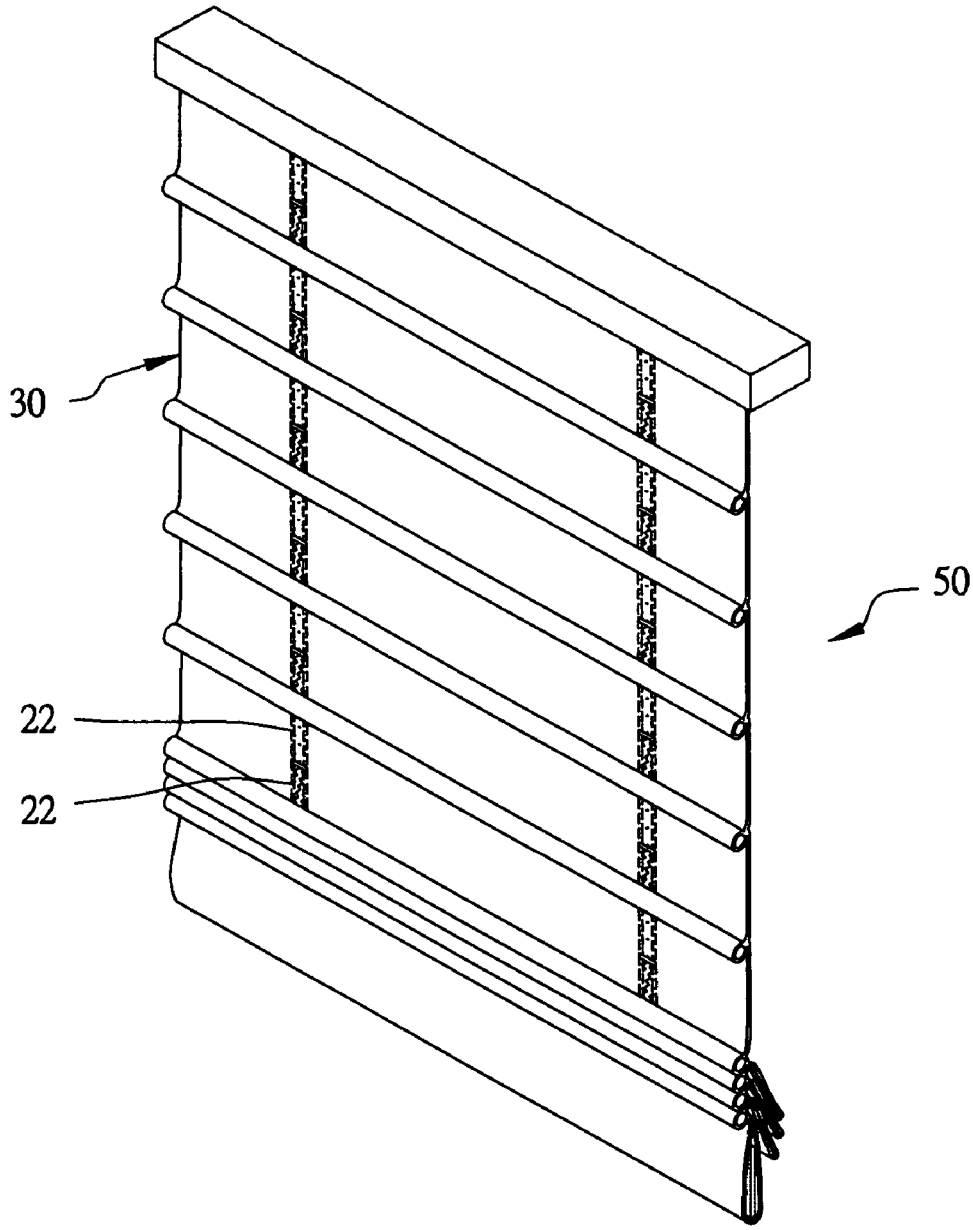
FIG. 5 is a perspective view of the lateral blind provided with the second embodiment of a collapsing and securing device in the present invention, showing it being collapsed.
Figure 6:
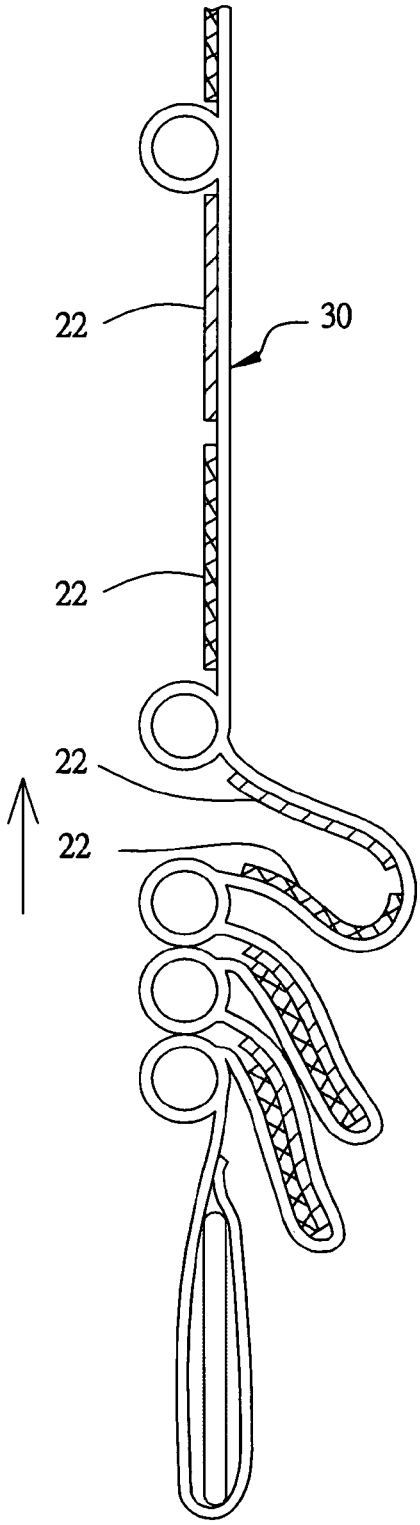
FIG. 6 is a partial side cross-sectional view of the lateral blind provided with the second embodiment of a collapsing and securing device in the present invention, showing it being collapsed.

Next, FIGS. 4, 5 and 6 show a second embodiment of a collapsing and securing device of a lateral blind in the present invention, which is used for a Roman blind 50. It includes two sets of two positioning members 20, and a plurality of blind strips 30 connected with lateral tubular members respectively between two blind strips 30 so as to form the Roman blind 50.

The two positioning members 20 are provided on a right side and a left side of an inner surface of the blind strips 30, respectively consisting of plural sets of two spaced Velcro bands 22 adhered on the inner surface of each blind strip 30.

In using the second embodiment of the collapsing and securing device, a user begins to fold up each blind strip 30 to let a lower half portion of the strip 30 to contact with an upper half portion of the same strip 30 so that the lower Velcro band 22 may overlap and tightly tangle with the upper Velcro band 22, and so repeating the same operation and then all the element strips 30 may be collapsed completely. On the contrary, if the lateral blind is to be expanded down from a collapsed position, a user pulls down the each folded blind strip 30, letting each set of the Velcro bands 22 separated from each other.

Figure 7:
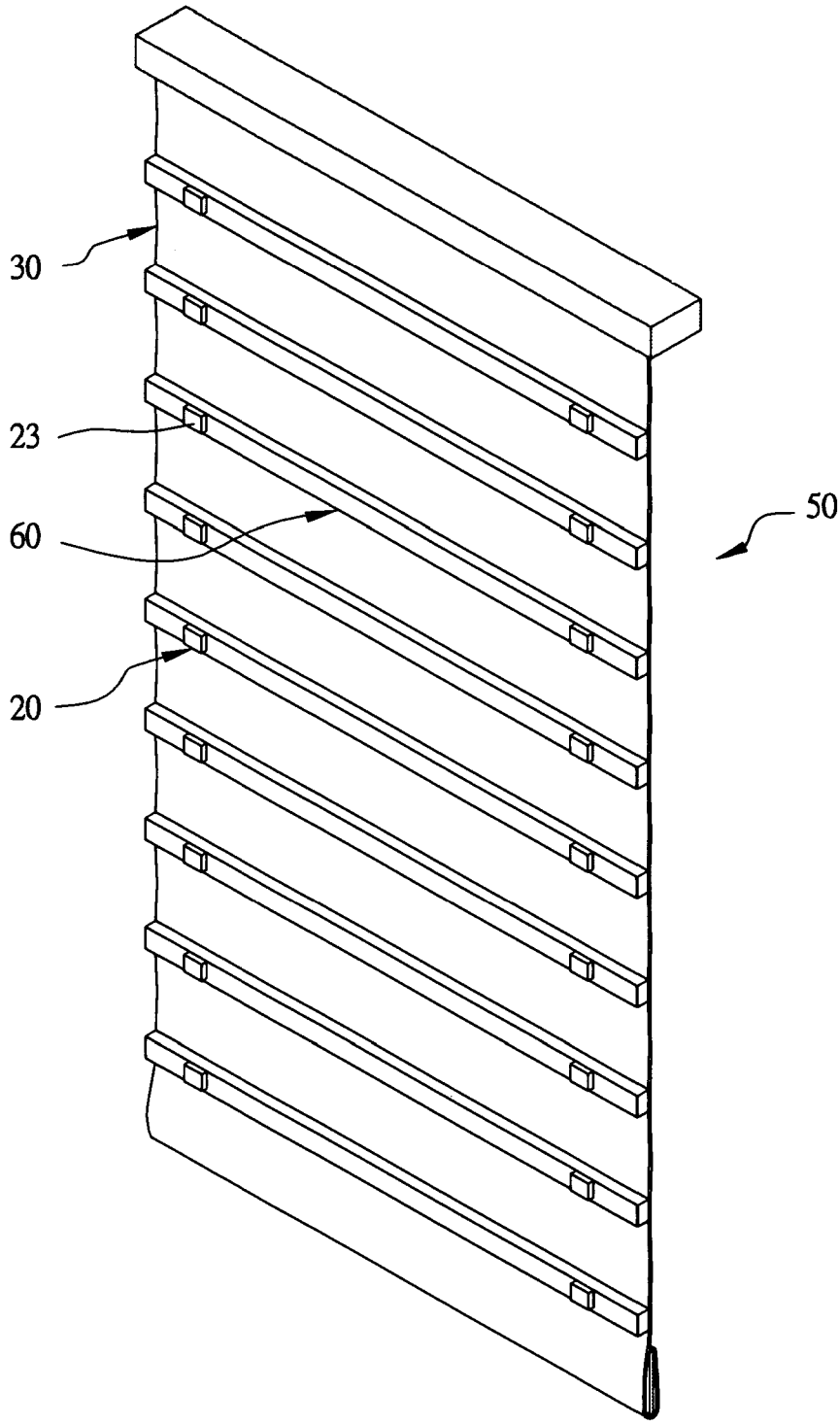
FIG. 7 is a perspective view of a lateral blind provided with a third embodiment of a collapsing and securing device in the present invention.
Figure 8:
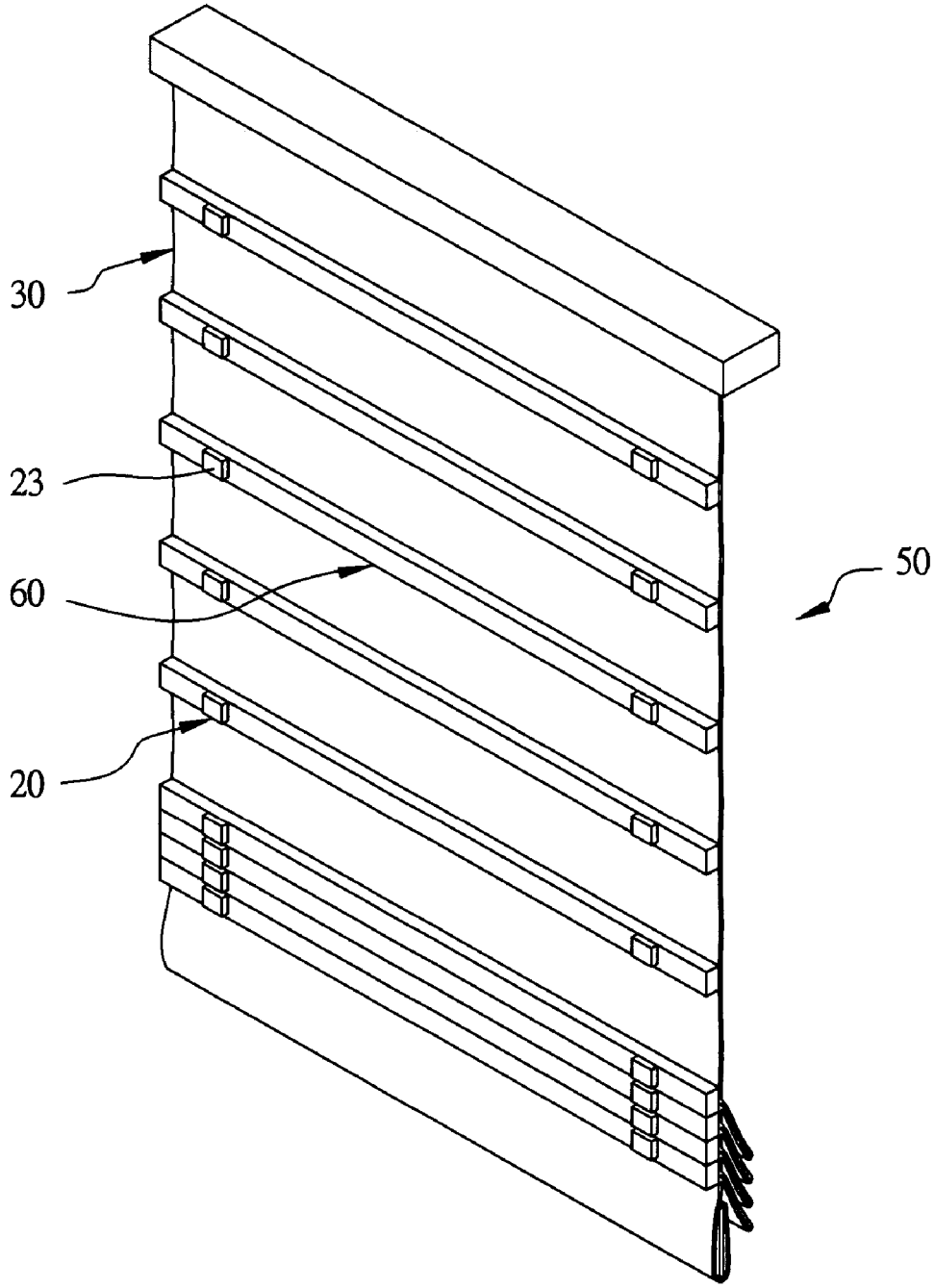
FIG. 8 is a perspective view of the lateral blind provided with the third embodiment of a collapsing securing device in the present invention, showing it being collapsed; and, FIG. 9 is a partial cross-sectional view of the lateral blind provided with the third embodiment of a collapsing and securing device in the present invention, showing it being collapsed.
Figure 9:
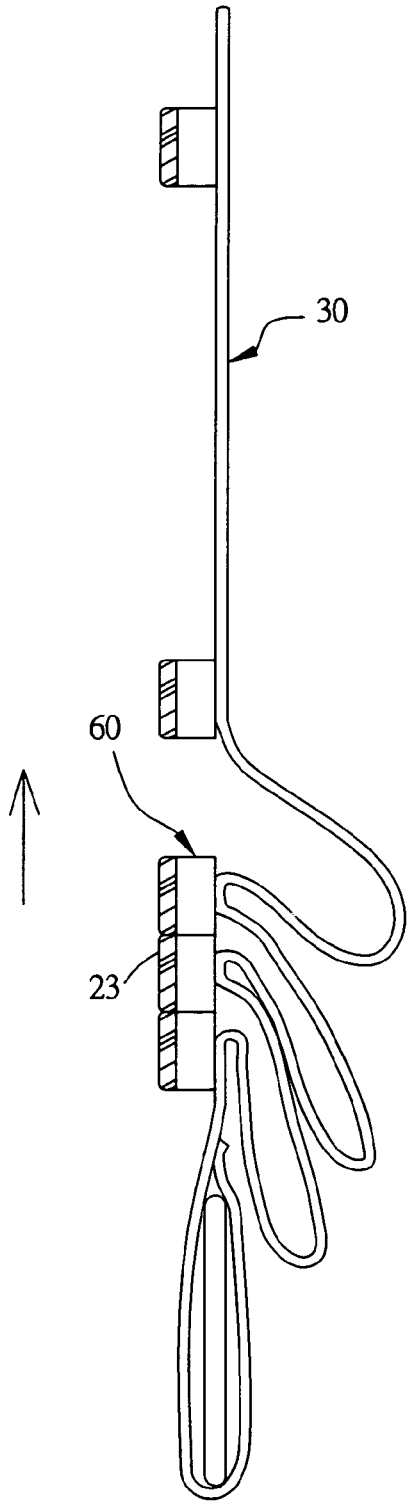

In addition, FIGS. 7, 8 and 9 show a third embodiment of a collapsing and securing device a lateral blind, in which positioning members 20 are made of plural magnets 23, and a plurality of wooden bars 60 fixed laterally and spaced apart on a front surface of a Roman blind for collapsing. Then the magnets 23 are fixed respectively at a right side and a left side of each wooden rod 60. In using, a user pushes up the wooden rods 60 to lie side by side and to let the magnets 23 mutually attract one another, with each section of the Roman blind 50 folded and kept in that position by the attracting force of the magnets 23. The collapsed condition of the third embodiment is almost the same as that of the second embodiment. On the contrary, in expanding the collapsed condition of the lateral blind provided with the third embodiment, a user pulls the wooden rods 60 to separate from one another, forcing the magnets 23 separate from one another at the same time. Moreover, the magnets 23 used for the positioning members 20 can be replaced by hooks or Velcro bands (not shown in the Figures).

Besides, a fourth embodiment of the invention can be applied to a wave-shaped lateral blind (shown) includes positioning members provided with Velcro bands, magnets, or hooks fixed space d apart, and then attached lengthwise on an inner surface of a lateral blind. Then the lateral blind forms plural waves between every two positioning members in case of being collapsed, enabling every upper and every lower element of the positioning members to adhere, attract or hook with each other so as to keep the collapsed position.

The invention has the following advantages, as can be understood from the foresaid description.

1. The positioning member can used to collapse and secure at the same time a lateral blind such as a winding blind, a Roman blind, or a cloth blind, without using a pull rope with a loop as used in a conventional lateral blind so as to get rid of potential dangers involved in the conventional ones.
2. It includes different embodiments for a consumer to select according to personal taste, applicable to a common lateral blind, a Roman blind or a cloth blind.
3. A lateral blind provided with any embodiment of a collapsing and securing device in the invention can be handled with a little force and quickness, as the positioning members used are very simple materials such as Velcro bands, magnets etc. generating attractive force or tangling and sticking force.

While the preferred embodiments of the invention have been described above, it will be recognized and understood that various modifications may be made therein and the appended claims are intended to cover all such modifications that may fall within the spirit and scope of the invention.

What is claimed is:

1. A lateral blind comprising:

a) a blind movable between an expanded position and a plurality of collapsed positions; and b) a plurality of positioning members fixed on at least one side of the blind and securing the blind in one of the plurality of retracted positions, wherein the plurality of positioning members includes two sets of positioning members positioned vertically on the blind and spaced apart, each of the two sets of positioning members includes a first connector located on a front of the blind and a second connector located on a back of the blind, the blind is positioned in one of the plurality of collapsed positions by winding the blind and selectively connecting a selected length of the first connector with a selected length of the second connector of each of the two sets of positioning members.

2. The blind according to claim 1, wherein the plurality of positioning members are hoop and loop fasteners.

3. The blind according to claim 1, wherein each of the two sets of positioning members extends from a top of the blind to a bottom of the blind.

4. The blind according to claim 1, further comprising a lower rod connected to a bottom of the blind and having two grips, one of the two grips extending outwardly from each of two opposing sides of the blind.

5. The blind according to claim 1, further comprising a plurality of folding bars positioned horizontally and spaced apart on a front of the blind, at least one positioning member of the plurality of positioning members is connected to each of the plurality of folding bars, wherein the blind is positioned in one of the plurality of collapsed positions by selectively connecting the at least one positioning member of each of a predetermined number of the plurality of folding bars together.

6. The blind according to claim 5, wherein the plurality of positioning members are hoop and loop fasteners.

7. The blind according to claim 5, wherein the plurality of positioning members are a hooking members.

8. The blind according to claim 5, wherein each of the plurality of folding bars is made of wood.

9. The blind according to claim 1, wherein the plurality of positioning members are positioned horizontally on a front of the blind and spaced apart, each of the plurality of positioning members is selectively connected to an adjacent positioning member, the blind is positioned in one of the plurality of collapsed positions by selectively connecting a predetermined number of the plurality of positioning members together.

10. The blind according to claim 9, wherein the plurality of positioning members are hoop and loop fasteners.

11. The blind according to claim 9, wherein the plurality of positioning members are magnets.

12. The blind according to claim 9, wherein the plurality of positioning members are a hooking members.

13. A lateral blind comprising:

a) a blind movable between an expanded position and a plurality of collapsed positions; and b) a plurality of positioning members fixed on at least one side of the blind and securing the blind in one of the plurality of retracted positions, wherein the blind includes a plurality of horizontal blind sections, each of the plurality of horizontal blind sections has two sets of positioning members positioned vertically on a front thereof and spaced apart, each of the two sets of positioning members includes a first connector located on a top portion of one of the plurality of horizontal blind sections and a second connector located on a bottom portion of one of the plurality of horizontal blind sections, the blind is positioned in one of the plurality of collapsed positions by selectively connecting the first connector with the second connector of each of the two sets of positioning members of a predetermined number of the plurality of horizontal blind sections.

14. The blind according to claim 13, wherein the plurality of positioning members are hoop and loop fasteners.

15. A lateral blind comprising:

a) a blind movable between an expanded position and a plurality of collapsed positions;

b) a plurality of positioning members fixed on at least one side of the blind and securing the blind in one of the plurality of retracted positions; and c) a plurality of folding bars positioned horizontally and spaced apart on a front of the blind, at least one positioning member of the plurality of positioning members is connected to each of the plurality of folding bars, wherein the blind is positioned in one of the plurality of collapsed positions by selectively connecting the at least one positioning member of each of a predetermined number of the plurality of folding bars together, wherein the plurality of positioning members are magnets.

* * * * *